US006636458B1

(12) United States Patent
Uptegraph

(10) Patent No.: US 6,636,458 B1
(45) Date of Patent: Oct. 21, 2003

(54) WATERPROOF TIMER

(75) Inventor: Greg S. Uptegraph, Clementon, NJ (US)

(73) Assignee: Lux Products Corporation, Mount Laurel, NJ (US)

( * ) Notice: Subject to any disclaimer, the term of this patent is extended or adjusted under 35 U.S.C. 154(b) by 0 days.

(21) Appl. No.: 09/537,844

(22) Filed: Mar. 29, 2000

(51) Int. Cl.[7] ..... G04B 37/00; G04F 10/00; G04F 8/00

(52) U.S. Cl. ..... 368/88; 368/107; 368/276; 368/291

(58) Field of Search ..... 368/88, 276, 281, 368/107–113, 286, 291, 204, 309

(56) References Cited

U.S. PATENT DOCUMENTS 4,232,512 A * 11/1980 Yoshikawa et al. ..... 368/82
4,241,442 A * 12/1980 Grohoski ..... 368/294
4,272,838 A * 6/1981 Kasama et al. ..... 368/88
4,287,676 A * 9/1981 Weinhaus
4,310,908 A * 1/1982 Fuerneisen ..... 368/88
5,396,473 A * 3/1995 Crettenand ..... 368/204
5,774,427 A * 6/1998 Rebeaud ..... 368/321
5,854,774 A * 12/1998 Timme ..... 368/10
5,933,391 A * 8/1999 Uptegraph ..... 368/69
6,104,674 A * 8/2000 Emoff et al. ..... 368/109
6,345,015 B1 * 2/2002 Coulson ..... 368/10

* cited by examiner

*Primary Examiner*—Vit Miska
(74) *Attorney, Agent, or Firm*—Piper Rudnick LLP

(57) ABSTRACT

A waterproof electronic kitchen timer having a casing that can withstand gentle washing under a kitchen faucet for removal by detergents of grease and other soils.

4 Claims, 10 Drawing Sheets

WATERPROOF TIMER

BACKGROUND OF THE INVENTION

This invention relates to a waterproof electronic kitchen timer that is readily washable. It can withstand a gentle washing under a kitchen faucet, which greatly benefits in a kitchen environment where a timer is typically exposed to grease and various sorts of cooking and baking elements.

Prior kitchen timers currently in use have suffered from exposure to grease and other cooking and baking elements, which have been able to penetrate into the mechanical or other working elements within the timer casing. Endeavors to clean timers out after they have become soiled by the kitchen environment have often resulted in penetration of water and cleaning fluids into the timer interior shortening timer life.

It is an object of this invention to provide a kitchen timer which provides accurate electronic timing within a washable waterproof case, has a large easy-to-read time display and a loud extended alarm, and is capable of timing over an extended period.

It is a further object of this invention to provide a washable, waterproof timer having a non-slip base and an elevated viewing angle, and which can serve as a repeat timer operated by simple, one-finger setting.

It is another object of this invention to provide a timer which may be safely held under a kitchen faucet to clean it, without damaging the special electronic timer circuitry or causing any other damage.

These and other examples of advantages and benefits of the timer in accordance with this invention will become apparent in the specification hereafter, and in the drawings, of which:

DETAILED DESCRIPTION OF THE PREFERRED EMBODIMENT

Figure 1:
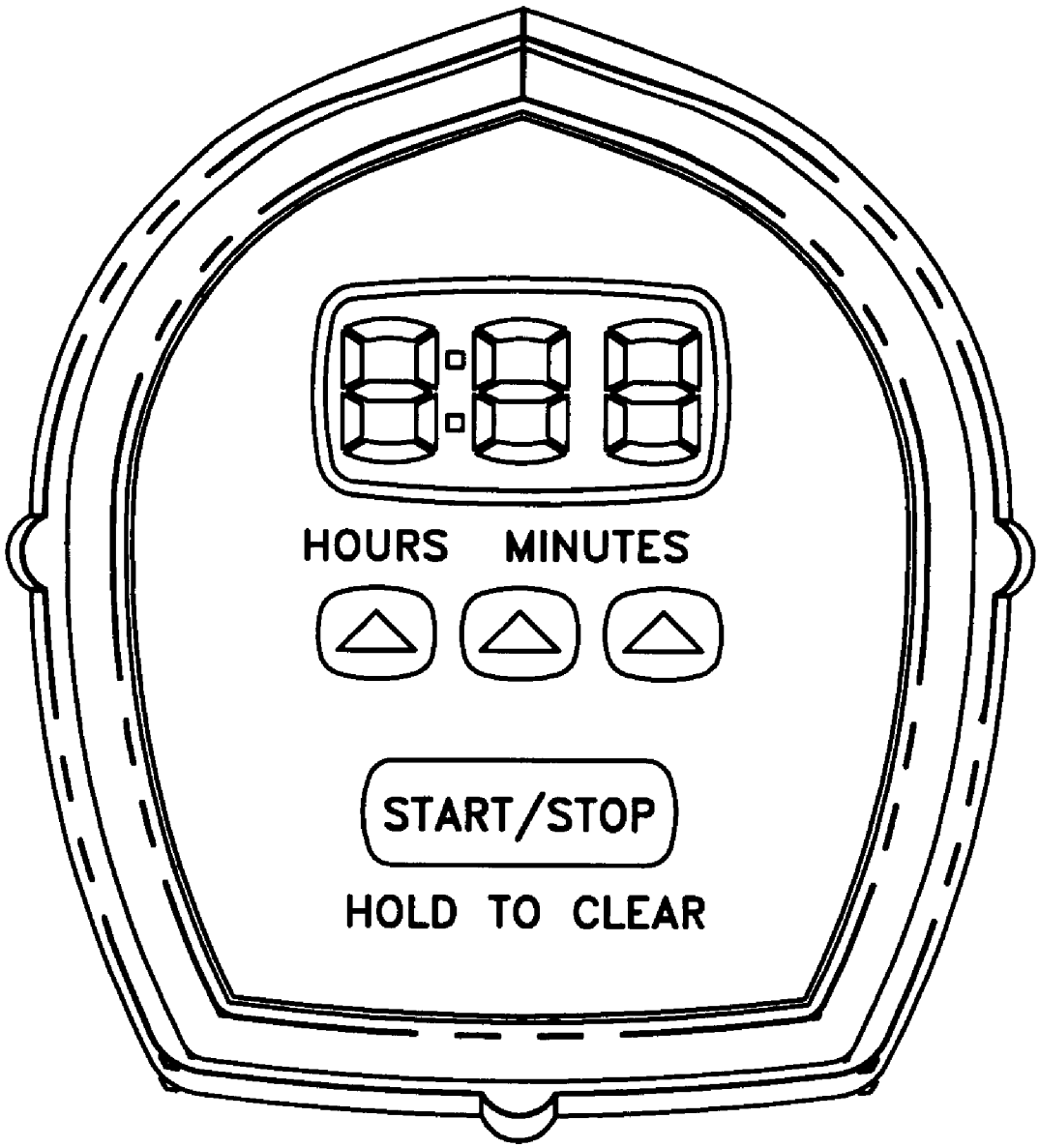
FIG. 1 is a face view of one specific form of timer embodying feature of this invention.
Figure 2:
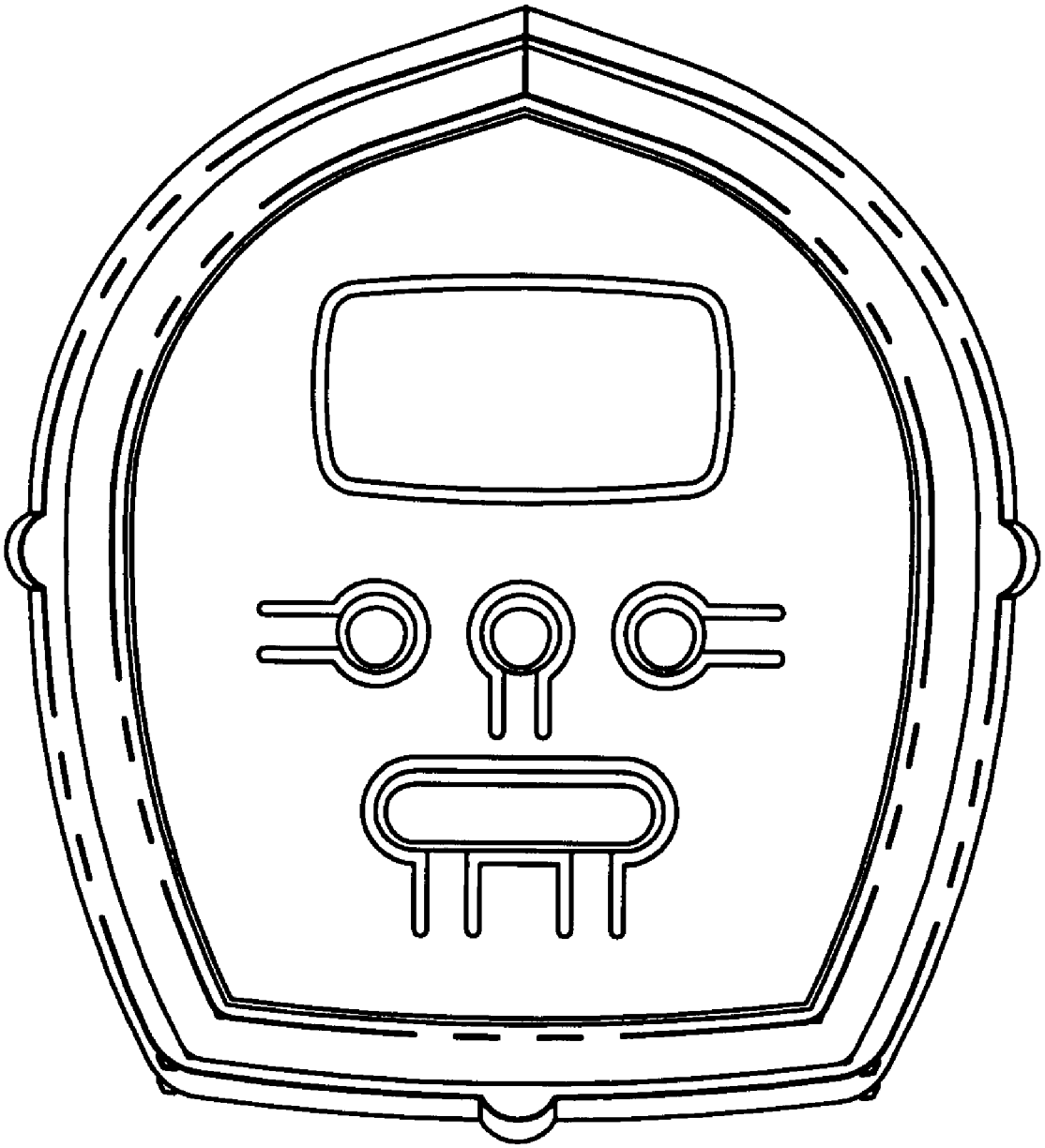
FIG. 2 is a sectional view taken along the lines and arrows II—II which appear in FIG. 3.
Figure 3:
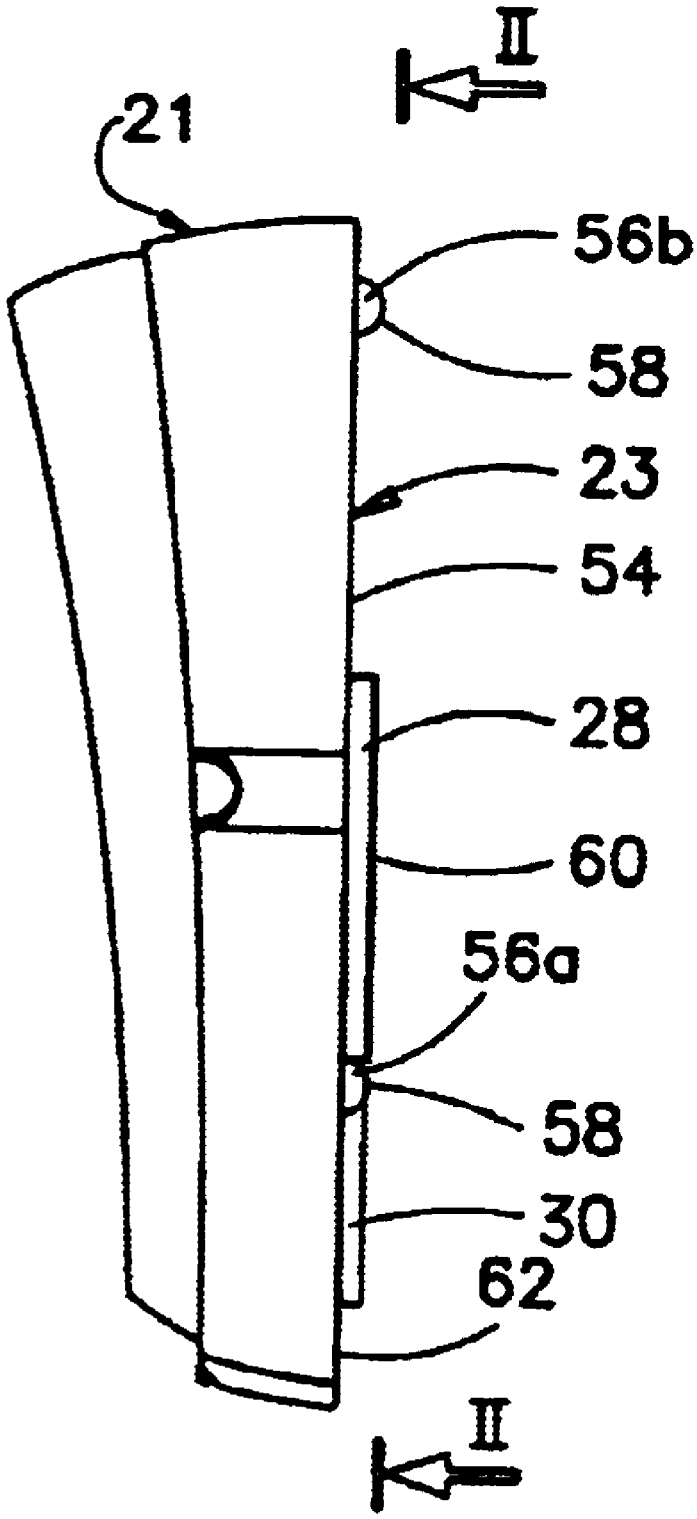
FIG. 3 is a side view of the timer illustrated in FIG. 1.
Figure 4:
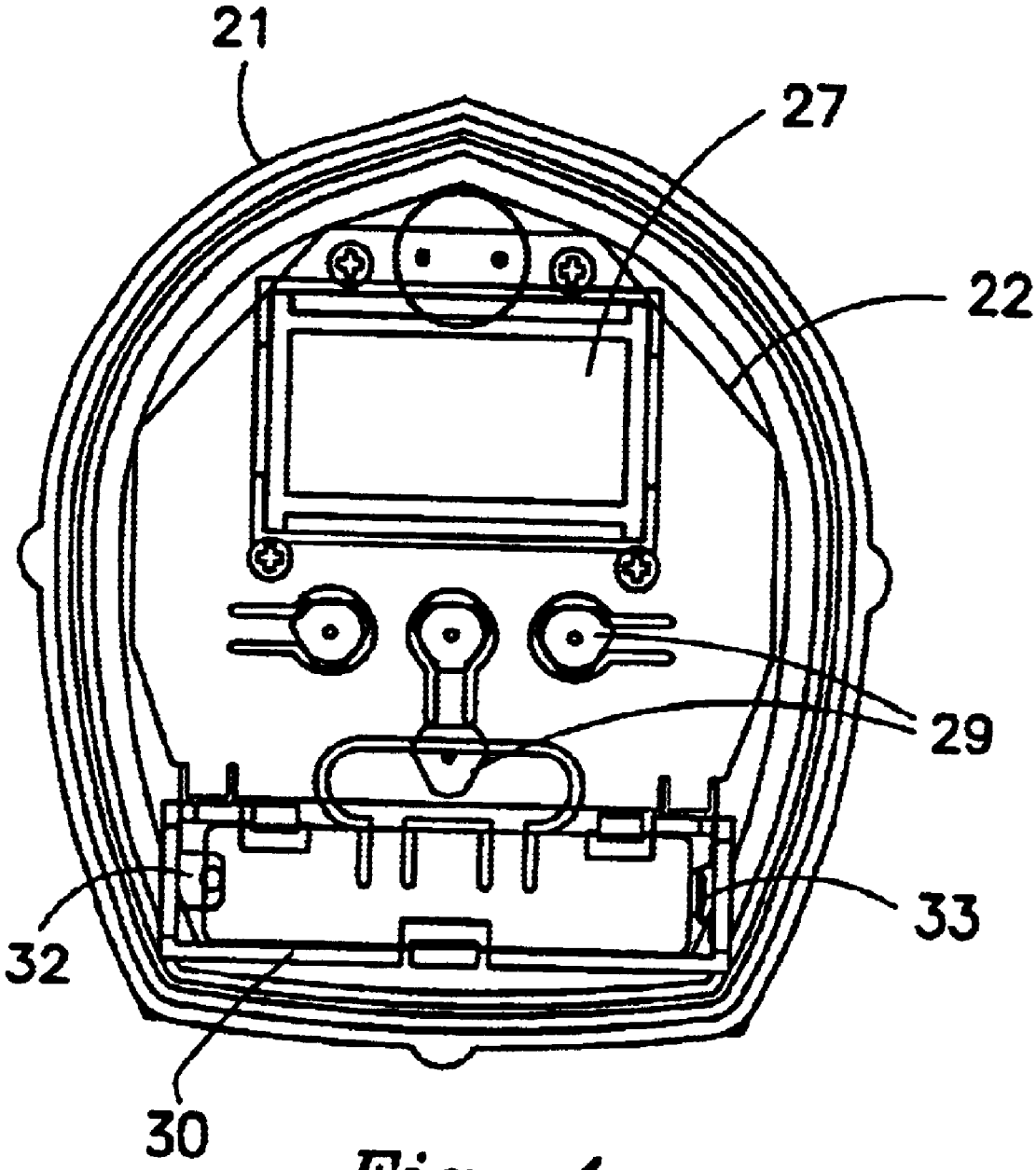
FIG. 4 is a sectional view taken along the lines and arrows IV—IV which appear in FIG. 5.
Figure 8:
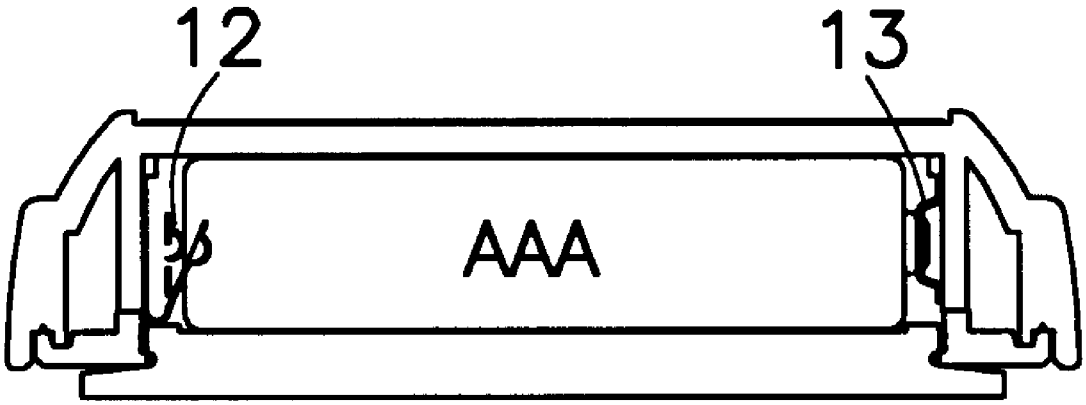
FIG. 8 is a sectional top plan view taken along the lines and arrows VIII—VIII which appear in FIG. 6 illustrating an internal battery casing which is a component of the timer of this invention.
Figure 9:
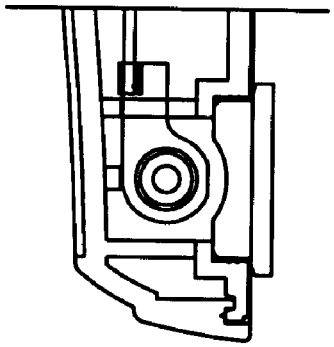
FIGS. 9 and 10 are sectional fragmentary views thereof, taken along the lines and arrows IX—IX and X—X, respectively.
Figure 10:
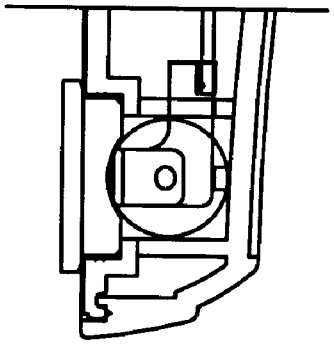
Figure 11:
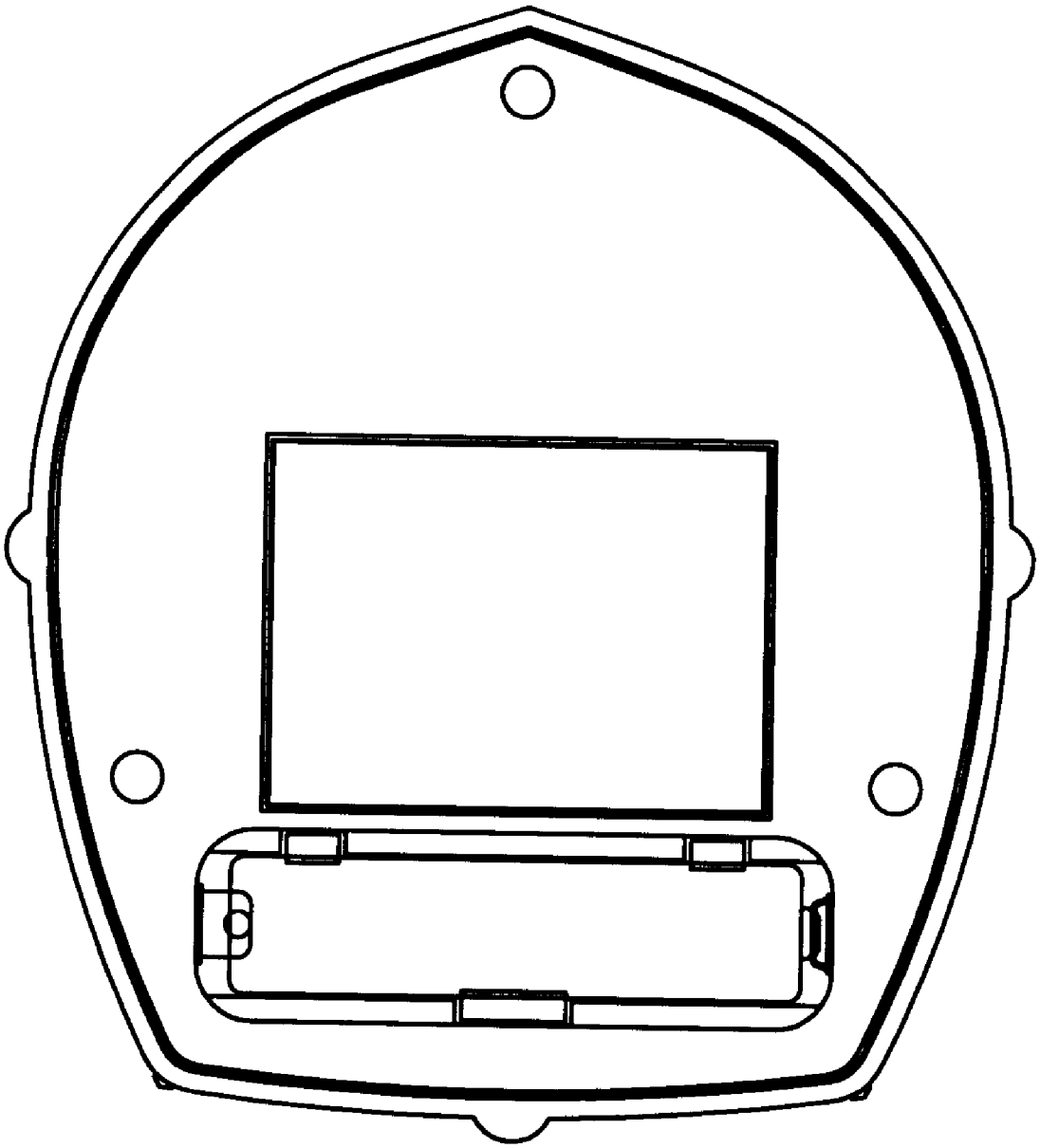
FIG. 11 is a further sectional view taken along the lines and arrows B—B which appear in FIG. 5 illustrating the battery casing position in the timer.

Illustrated in the foregoing drawings, the number 21 designates the top cabinet, the number 22 designates the PCB, the number 23 designates the bottom cabinet, 24 is a screw and 25 designates the LCD support. The number 26 designates a sound generator for the timer, the number 27 designates an LCD and the number 28 designates magnetic rubber. A contact dome 29 is provided, while 30 designates a battery door (which, as shown in FIGS. 3 and 4, may comprise an access panel that may be a removable panel or a hinged door, for example), 31 a relay, 32 a battery contact plate (negative) and the number 33 a battery contact plate (positive). A battery here shown as (AAA) is shown in the battery housing appearing in FIG. 8 of the drawings, electrically connected to operate the timer sound, connected between the battery terminals 12, 13.

Figure 5:
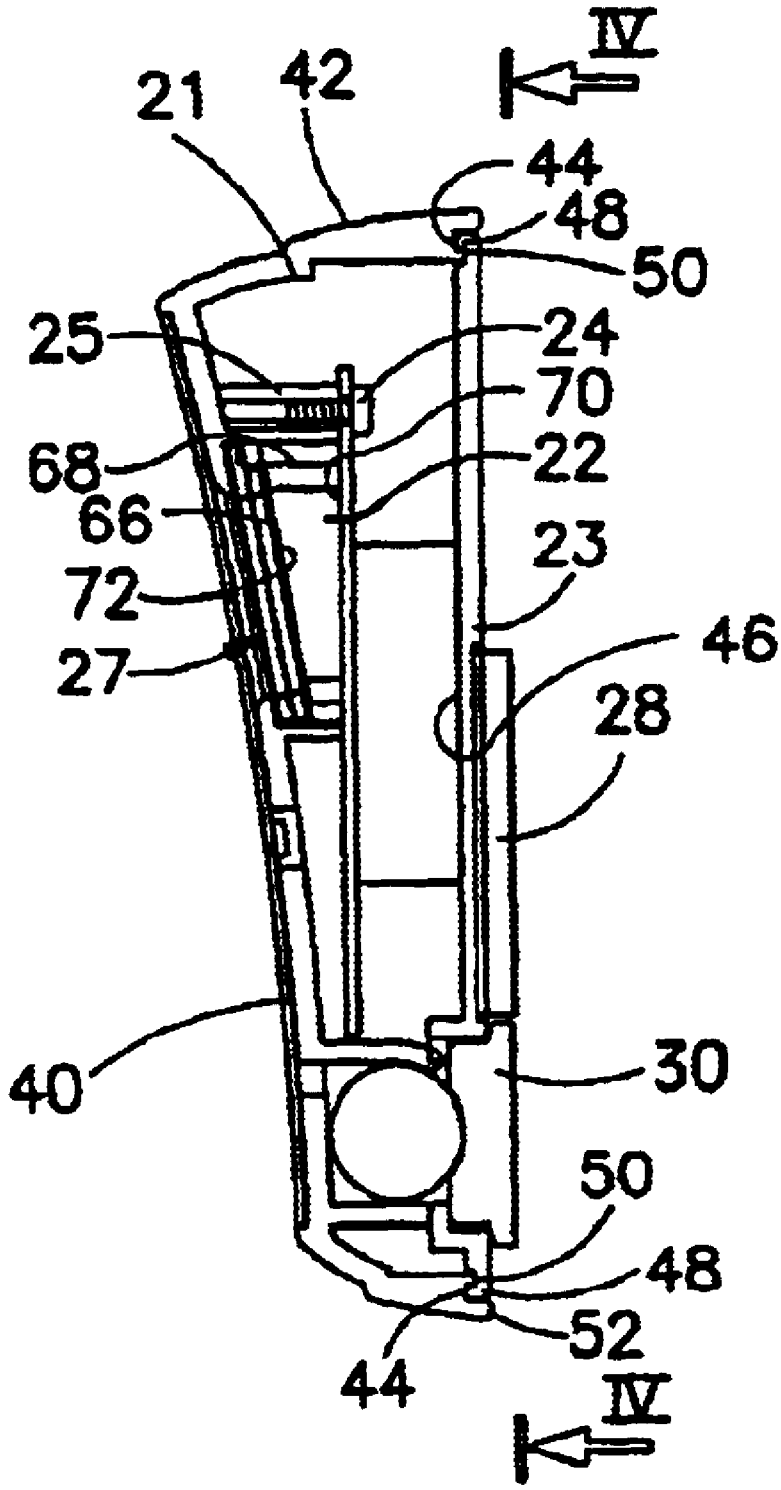
FIG. 5 is a view in side section, taken along the lines and arrows V—V which appear in FIG. 6.

As illustrated in FIG. 5, the top cabinet 21 in accordance with the present embodiment is generally cup shaped in configuration defining an upper wall 40 and a continuous side wall 42 connected at a first end to the upper wall and extending radially outward therefrom and terminating at a second end by a continuous channel 44. The bottom cabinet 23 in the present embodiment is generally planar in configuration and includes within an upper surface 46 a continuous wall 48 at its perimeter and a continuous channel 50 adjacent the wall 48 at the perimeter. On. assembly of the timer of the present embodiment, the top and bottom cabinets 21 and 23, respectively are coupled by positioning the wall 48 of the bottom cabinet 23 into the channel 44 of the top cabinet 21. In addition, preferably the top cabinet 21 also includes a continuous wall 52 adjacent its cavity which is received into the channel 50 provided in the bottom cabinet 23. The connection between the top cabinet 21 and bottom cabinet 23 provides a waterproof seal. Where desired, an adhesive, such as glue or other suitable material can be applied between the top and bottom cabinets 21 and 23.

Figure 6:
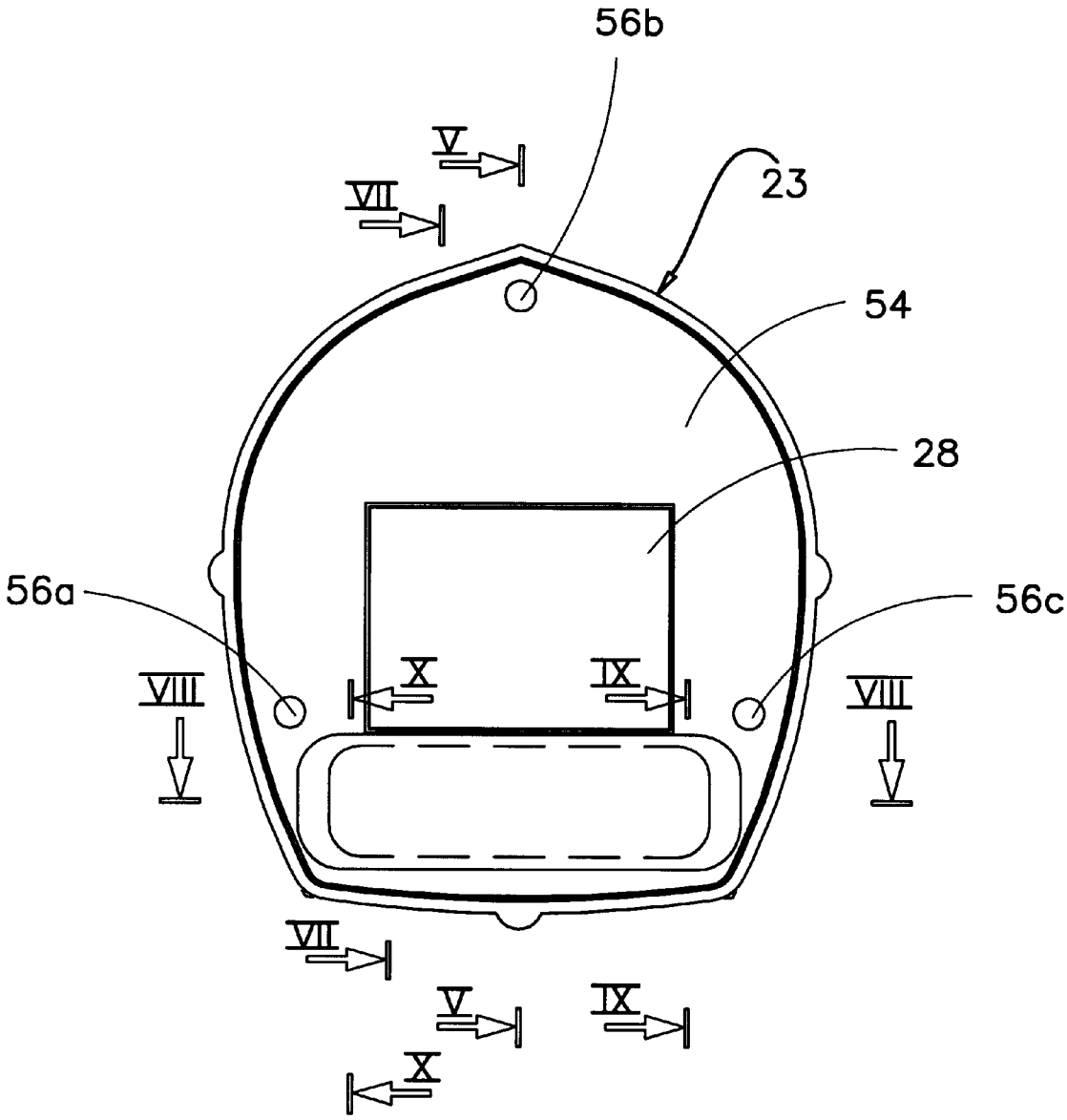
FIG. 6 is a rear view of the timer of FIG. 1.
Figure 7:
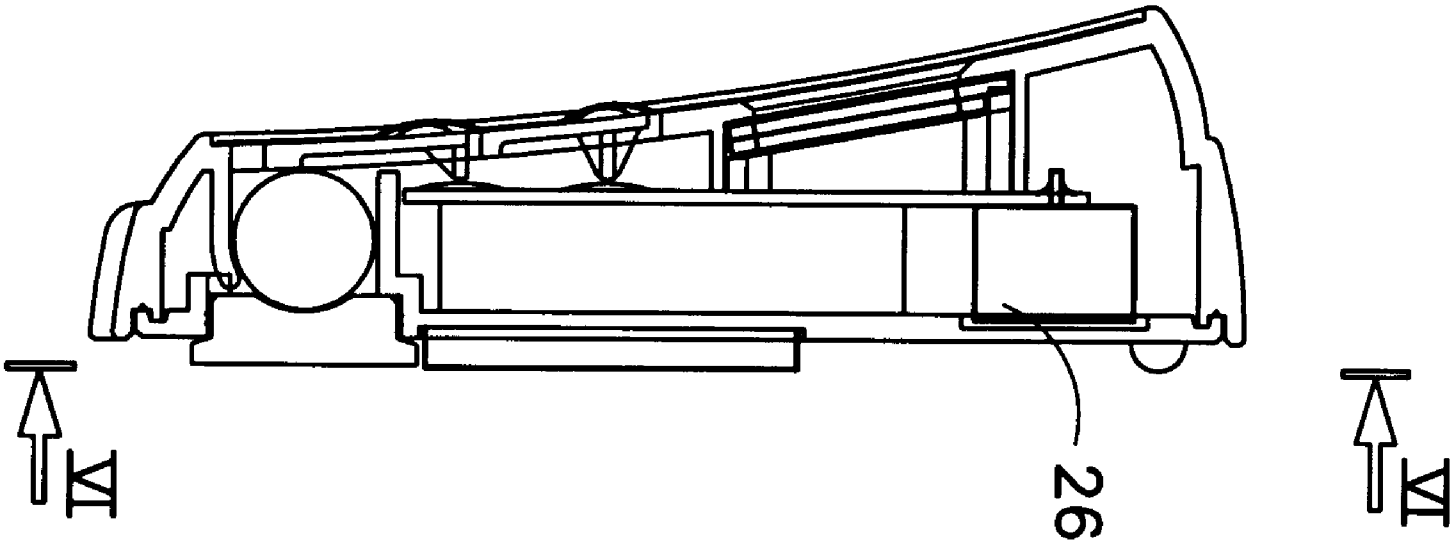
FIG. 7 is a sectional side view taken along the lines and arrows VII—VII which appear in FIG. 6.

As best illustrated in FIGS. 3 and 6, the bottom cabinet 23 further includes a bottom surface 54 and at least one, and in the present embodiment, three bosses 56*a*–56*c* extended from its bottom surface 54. As should be understood, any number of bosses can be utilized for the purpose described below. In this embodiment, the bosses 56*a*–56*c* are generally hemispherical in cross section, however, it should be understood that other cross sectional shapes can also be utilized where desired, such as square. The bosses 56*a*–56*c* operate as a stabilizer when the timer is mounted on a surface by the magnetic rubber 28. Specifically, the bosses 56*a*–56*c* limit pivotal rotation of the magnetic rubber 28, in order that the face of the magnetic 28 will be maintained in engagement with the mounting surface. In the present embodiment, preferably at least one pair of the bosses 56*a*–56*c* are substantially aligned and positioned opposing one another. In addition, as illustrated in FIG. 3, the terminating ends 58 of the bosses 56*a*–56*c* and the terminating end 60 of the magnetic rubber 28 extending from the bottom cabinet 23 are preferably positioned substantially along the same plane for stabilization of the timer in use against a mounting surface. Similarly, in the present embodiment, preferably the terminating end 62 of the connector 34 distal the bottom cabinet 23 is positioned substantially along the same plane as the terminating ends 58 and 60 of the bosses and magnetic rubber 28, respectively, for further stabilization.

As illustrated in FIGS. 4 and 5, the electronics are housed within the cavity provided between the top cabinet 21 and bottom cabinet 23. The PCB 22 is general planar and includes most of the electronics for the timer in order to minimize space. As shown in FIG. 5, the display 66 of the LCD 27 in this embodiment is preferably positioned at a slight incline relative to the planar surface of the PCB 22, which facilitates viewing of the display 66 by the user. For this purpose, the timer includes a platform 68 defining a bottom 70 end generally planar and seated against the planar surface of the PCB 22 and an incline 72 upon which the LCD display 66 is seated. In this embodiment, the platform 68 is generally rectangular in configuration with a central cavity, although other configurations can also be used for the same purpose.

It is important to observe that the timer in accordance with this invention is an electronic countdown timer, having a countdown time of 9 hours 59 minutes, for example. The LCD displays the count time, with three numeric digits as shown. There are three operating buttons providing settings for hours, tens of minutes and minutes. A start/stop button is provided, which can be operated by pressing and holding the reset counter.

The timer in accordance with this invention has watertight construction to provide environmental protection. It is important to observe that the housing of the timer is constructed of ABS, with a lexan overlay. The liquid crystal display is of 30×15.5 mm VA, and the ingress protection rating of the watertight structure of the timer is IP42.

The timer is connected to provide an extended timer "beep" sound of 80 decibels, for example, at 2 kHz after the designated time has elapsed.

With the construction shown and described herein, the timer can readily live up to a guaranteed usage of 10,000 cycles, assuming an average countdown duration of 2 hours and the use of an alkaline battery. Using the highly beneficial components employed in the timer, its storage temperature range is readily within the range of −20° C. to 55° C.

Operation

The operation of the timer in accordance with this invention is as follows: The user may press any key or insert a new battery to turn on the timer. The default initial display is "0:00," flashing at 1 Hz. If the user does not press any key within two minutes, the electronic circuitry described in the drawings will automatically turn the unit off in order to save battery power.

The operator may use the "Hr" button or the "10s Min" button or the "Min" button to set the desired countdown duration. When the "Hr" button is pressed, only the left-most digit is scrolled to show that the hour is set. When the "10s Min" button is pressed, only the middle digit is scrolled to show that ten minutes is set. When the "Min" button is pressed, only the right-most digit is scrolled to show that the minutes are set. The operator may set any set value, which remains on display. As noted, if the user does not press any key within two minutes, the unit will auto-off in order to save battery power.

In order to start the countdown, when the start button is pressed, the counter starts and the corresponding indicating colon flashes for each second elapsed until "0:01" is reached, next starts the second count, and the display shifts to "0:59" and each second countdown is then rolled out on the display.

When the countdown time has reached zero, the alarm sounds for ten seconds while the original setting is displayed and flashes at 1 Hz.

The user may press the stop button once, and this stops the alarm sound and the flashing. During countdown, the three buttons "Hr," "10s Min" and "Min" are disabled.

By pressing the stop button at any time the user may stop the countdown temporarily, and may press again to continue with the remaining countdown. During the timer pause, the three buttons are disabled.

The original setting remains on display as a standby mode after countdown. This original setting can be used as the next countdown setting if desired. This can be done by simply pressing the start button once, which causes the timer to use this setting to count down again. If the user does not press any key in standby mode for two minutes, the unit will turn auto-off. The set value can be changed at the standby mode.

In order to reset the timer, the user can simply press and hold the "START/STOP" button at any time for more than two seconds, which resets the counter immediately and the values set will be cleared from memory, back to default. If no further action from the user is taken within two seconds, the unit will auto-off to save battery energy.

A QC mode is available; the user may merely press and hold the "START/STOP" button and then power up the unit to enter the QC mode. In QC mode, the unit will turn on all the LCD segments for one second and then generate a beep sound.

It will accordingly be apparent that the washable electronic timer in accordance with this invention is provided with washable waterproof case, is large and easy to read, can provide a loud extended alarm, and can monitor time ranges up to 10 hours or more. It has a useful magnetic refrigerator mount, a non-slip base, an elevated viewing angle, and can be handled by simple one-finger setting in the usual way or as a repeat timer. The rubber gasketing operates in conjunction with the lexan coating and the watertight construction to provide excellent environmental protection, and easy cleaning for the timer, and the ingress protection rating of the watertight design is as high as IP42 or above. Accordingly, the timer in accordance with this invention can withstand rough usage and can be cleaned repeatedly to bring it back to its as-new appearance and function.

Although this timer has been described in conjunction with one specific example, it will be apparent that various modifications of individual components may be performed, without interfering with the important advantages recited in this specification.

What is claimed is:

1. An electronic kitchen timer having a casing that can withstand gentle washing under a kitchen faucet for removal by detergents of grease and other soils, said timer comprising:

a sealable container casing holding an electronic timing device and connected timer display, and an electric power source contained inside said casing;

said casing having an access panel, positioned for access through an opening to said power source in a manner to substantially prevent entry of water into said casing when said panel is sealed in said opening; and a plurality of bosses and a magnet extending from a lower surface of said casing, all being positioned substantially on a single plane.

2. The kitchen timer of claim 1, wherein said access panel includes an outer surface positioned substantially on said single plane.

3. A substantially waterproof electronic kitchen timer comprising:

an electronic countdown timer, said countdown timer being programmed to count from a selected time;

a display in electronic communication with said countdown timer for displaying said count;

a power source for powering said electronic countdown timer;

a sealable container casing for containing said electronic countdown timer, said display, and said power source therein, said sealable container casing, wherein said casing defines a top cabinet and a bottom cabinet, with the top cabinet defining an upper wall and a substantially continuous side wall attached at a first end to said upper wall and said bottom cabinet defining a generally elongate member and a perimeter, wherein said bottom cabinet is attached proximate said perimeter to a second end of said substantially continuous side wall;

an access panel in said sealable container casing positioned for accessing to said power source through an opening to substantially seal said opening when said panel is closed; and a plurality of bosses and a magnet extending from a lower surface of said bottom cabinet, wherein said plurality of bosses further comprises terminating ends and with said terminating ends of said bosses and said magnet each being positioned substantially on a single plane.

4. The kitchen timer of claim 3, wherein said access panel includes an outer surface positioned substantially on said single plane.

* * * * *